US010697651B2

(12) United States Patent
Nolan et al.

(10) Patent No.: US 10,697,651 B2
(45) Date of Patent: Jun. 30, 2020

(54) ENERGY EFFICIENT COMBUSTION HEATER CONTROL

(71) Applicant: INTEL CORPORATION, Santa Clara, CA (US)

(72) Inventors: Michael Nolan, Maynooth (IE); Keith Nolan, Mullingar (IE); Mark Kelly, Leixlip (IE); Damian Kelly, Naas (IE); Niall Cahill, Galway (IE); John Brady, Celbridge (IE)

(73) Assignee: Intel Corporation, Santa Clara, CA (US)

( * ) Notice: Subject to any disclaimer, the term of this patent is extended or adjusted under 35 U.S.C. 154(b) by 775 days.

(21) Appl. No.: 14/757,727

(22) Filed: Dec. 23, 2015

(65) Prior Publication Data

US 2017/0184315 A1 Jun. 29, 2017

(51) Int. Cl.

| | |
|---|---|
| ***F24D 19/10*** | (2006.01) |
| ***F24B 13/04*** | (2006.01) |
| ***F24D 5/02*** | (2006.01) |
| ***F24B 1/19*** | (2006.01) |
| ***F24B 1/187*** | (2006.01) |

(52) U.S. Cl.

CPC ..... *F24D 19/1084* (2013.01); *F24B 1/187* (2013.01); *F24B 1/19* (2013.01); *F24B 13/04* (2013.01); *F24D 5/02* (2013.01); *F24D 2200/065* (2013.01); *F24D 2220/0214* (2013.01); *F24D 2220/042* (2013.01)

(58) Field of Classification Search

CPC ..... F24D 19/1084; F24D 5/02; F24B 1/187; F24B 1/19; F24B 13/04

USPC ..... 237/2 A

See application file for complete search history.

(56) References Cited

U.S. PATENT DOCUMENTS

| | | | | |
|---|---|---|---|---|
| 4,339,998 | A * | 7/1982 | Finch | F23N 1/005 110/101 CC |
| 4,503,782 | A * | 3/1985 | Helton | F24B 13/02 110/101 CC |
| 4,773,850 | A * | 9/1988 | Bushman | F27B 9/023 432/12 |
| 4,895,081 | A * | 1/1990 | Homer | G01N 33/222 110/101 CC |
| 5,009,217 | A * | 4/1991 | Johnson | F24B 1/187 116/169 |

(Continued)

FOREIGN PATENT DOCUMENTS

| | | | | |
|---|---|---|---|---|
| EP | 2682674 A2 * | 1/2014 | | F23N 5/022 |
| JP | 2014-142169 A * | 8/2014 | | |
| WO | WO 2016189437 A1 * | 12/2016 | | |

OTHER PUBLICATIONS

Matthiessen, EP 2682674 A2 English machine translation, Jan. 8, 2014 (Year: 2014).*

*Primary Examiner* — Edelmira Bosques
*Assistant Examiner* — Phillip Decker
(74) *Attorney, Agent, or Firm* — International IP Law Group, P.L.L.C.

(57) ABSTRACT

A method and apparatus for controlling a combustion heater are provided. An example method includes measuring a room temperature, measuring a combustion heater temperature, and measuring a fuel weight. Adjustments are computed to an operational parameter to adjust a room temperature. An anticipatory alert is provided to inform a user of a predicted time at which the fuel weight will be too low to maintain the room temperature.

25 Claims, 7 Drawing Sheets

(56) References Cited

U.S. PATENT DOCUMENTS 5,276,434 A * 1/1994 Brooks ..... G08B 21/14 340/632
5,632,614 A * 5/1997 Consadori ..... F23N 5/082 219/260
5,885,067 A * 3/1999 Jang ..... F23N 5/265 431/2
6,045,352 A * 4/2000 Nicholson ..... F23N 5/245 126/116 A
7,024,317 B1 * 4/2006 George ..... G01F 9/001 702/100
8,141,791 B2 * 3/2012 Rosen ..... G05D 23/1904 236/46 C
8,909,494 B2 * 12/2014 Lorden ..... G01F 9/001 702/100
10,082,306 B2 * 9/2018 Fadell ..... G05D 23/1902
10,201,674 B2 * 2/2019 Acker ..... A61M 16/12
2010/0096467 A1 * 4/2010 Kim ..... F24D 19/1009 237/12
2010/0237156 A1 * 9/2010 Minogue ..... F24B 1/183 237/59
2011/0157366 A1 * 6/2011 Padmanabh ..... H04N 7/15 348/159
2011/0300499 A1 * 12/2011 Simon ..... C11D 17/06 432/36
2014/0061322 A1 * 3/2014 Hrejsa ..... G05D 23/1932 236/11
2014/0069474 A1 * 3/2014 Forde ..... A62C 3/04 134/56 R
2014/0311477 A1 * 10/2014 Davenport ..... F24B 1/028 126/502
2015/0081086 A1 * 3/2015 Hallowell ..... F23G 7/10 700/209
2015/0137983 A1 * 5/2015 Johnson, Jr. ..... G06K 7/0095 340/632
2015/0239454 A1 * 8/2015 Sujan ..... F02D 41/1401 701/54
2015/0362217 A1 * 12/2015 Dresser ..... F23N 3/082 237/2 A
2016/0305659 A1 * 10/2016 Tulokas ..... F23D 17/002
2017/0102723 A1 * 4/2017 Smith ..... G05B 15/00
2018/0213970 A1 * 8/2018 Colston ..... A47J 37/07

* cited by examiner

100

400

600

ENERGY EFFICIENT COMBUSTION HEATER CONTROL

TECHNICAL FIELD

The present techniques relate generally to Internet of Things (IoT) devices. More specifically the present techniques relate to devices that can control combustion heating devices.

BACKGROUND

Two or more sources of renewable energy may be used in a home to attain classification in the highest category of energy efficiency rating. Despite other advances in heating systems, combustion heaters, such as fireplaces, wood stoves, peat stoves, and wood pellet furnaces, among others, remain a very popular choice for heating. For example, there are over 12 million stoves in the United States alone. Around nine million of these are legacy stoves that are over 50% less efficient than newer models.

Further, many of these systems control the air flow, e.g., the fan level, to produce a statically set internal temperature point. Thus, manual intervention is required to modify the temperature set point. Further, the internal temperature of the furnace does not easily relate to the desired room temperature.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

The control of combustion heaters for setting a room temperature may be challenging, since the fuel feed, air feed, and other parameters may be constant or binary, e.g., on/off, during operation. Accordingly, the temperature set point cannot be dynamically changed to best suit the local environmental conditions.

Further, monitoring of waste gas and fine particle emissions by control systems is not an existing feature of combustion heaters. A user must rely on external sensors, such as carbon monoxide detectors or smoke detectors, in order to provide an alert. As a result, a control system for a combustion heater is not capable of taking action to change the formation of the gases, e.g., increase its own air flow or operating parameters to reduce the levels of harmful gas.

Generally, the sensors used for temperature control of combustion heaters are internal and are scaled in hundreds of degrees. The user must learn from experience what internal temperature will provide a warm enough room. Further, the user must manually estimate fuel load and add to it as needed throughout the day and night. Additionally, the user must continually manually adjust the controls as the room warms, often resulting in the room cycling from being uncomfortably warm to slightly cooler than desired and it is a constant interruption to the activity that the user would like to be doing in the room.

In embodiments described herein, feedback data from multiple sensors in the room and combustion heater may be used to more efficiently control the combustion heater operations potentially decreasing the number of interactions with a user to hold a temperature.

Figure 1:
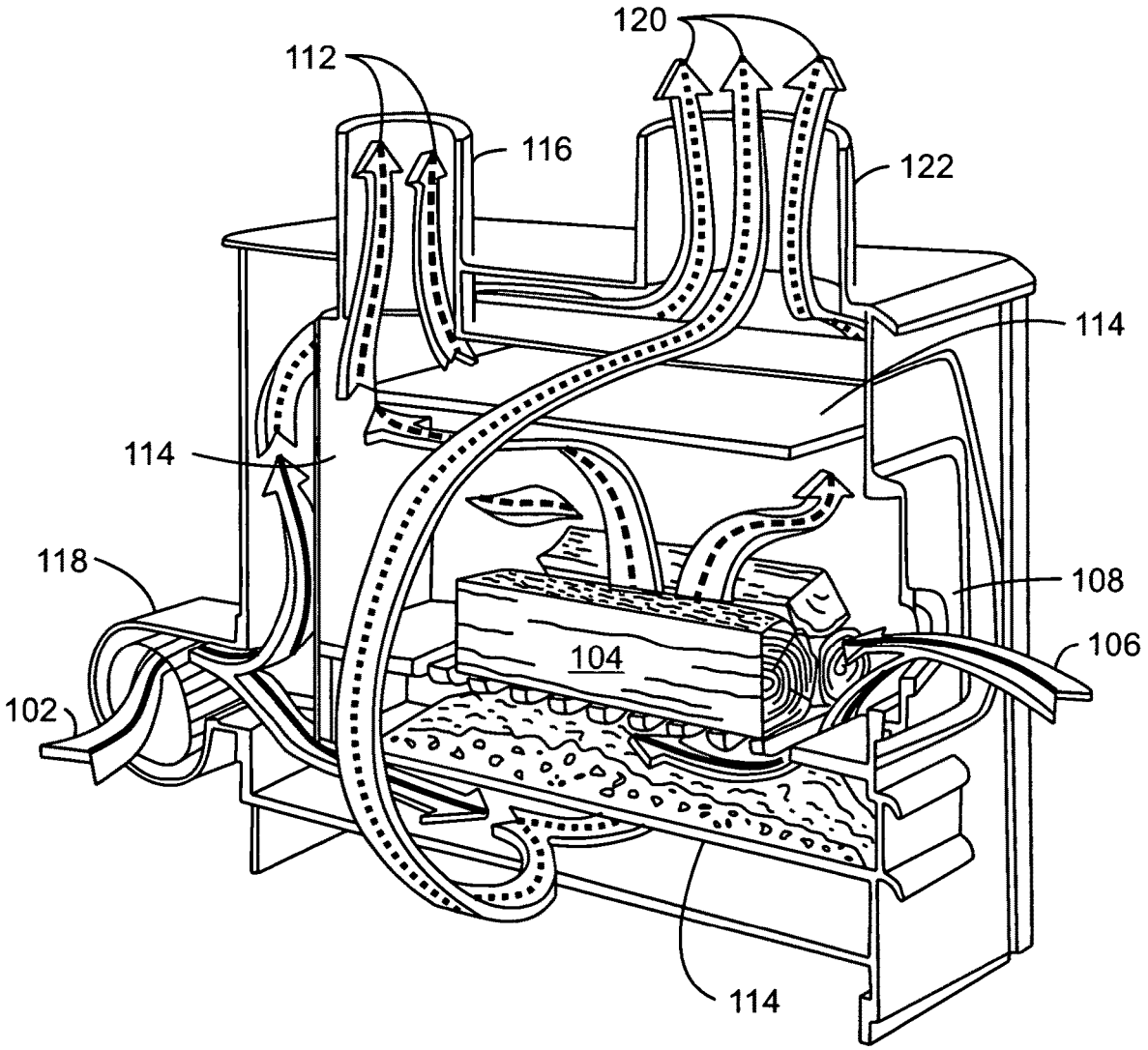
FIG. 1 is a drawing of a combustion heater that heats room air as wood is combusted.

FIG. 1 is a drawing of a combustion heater 100 that heats room air 102 as wood 104 is combusted. The combustion heater 100 may have an open front, e.g., a fireplace with forced air heating, or may be fully enclosed, e.g., a stove or furnace. In the combustion heater 100, one operational parameter that controls the fireplace 100 is the flow of fresh, or combustion, air 106 to the wood 104. An air inlet 108 may be adjusted to precisely control the flow of combustion air 106. The air flow controls the rate at which the wood 104 is consumed. More air results in the wood 104 being consumed more quickly, and thus, more heat being generated in a shorter time providing a higher output temperature. The combustion air 106 may be provided from outside the heated zone to avoid wasting heated air in the combustion.

A second operational parameter is the amount of burning wood 104 in the combustion heater 100. In some embodiments, weight sensors may be used to estimate the remaining fuel load, e.g., the amount of wood 104 that has not yet been consumed. This type of sensor may be used with any number of combustion heaters that have solid fuel loaded in large amounts, such as fireplaces, wood stoves, peat stoves, and the like. The smoke and other combustion products 112 may be removed from the firebox 114 through a flue vented to the outside. Room air 102 may be forced by a fan 118 in the spaces around the firebox 114 forming heated air 120 that is returned to the heated zone through a duct 122 at the top of the combustion heater 100.

Temperature sensors may be placed in the heated zone, the heated duct 122, the firebox 114, or any combinations thereof to provide information for controlling the combustion process. Further, gas and particulate sensors may be placed in the flue 116, the heated air duct 122, or both. The sensors may be used to optimize the combustion, to provide a warning if combustion products are entering the heated zone, or both.

Figure 2:
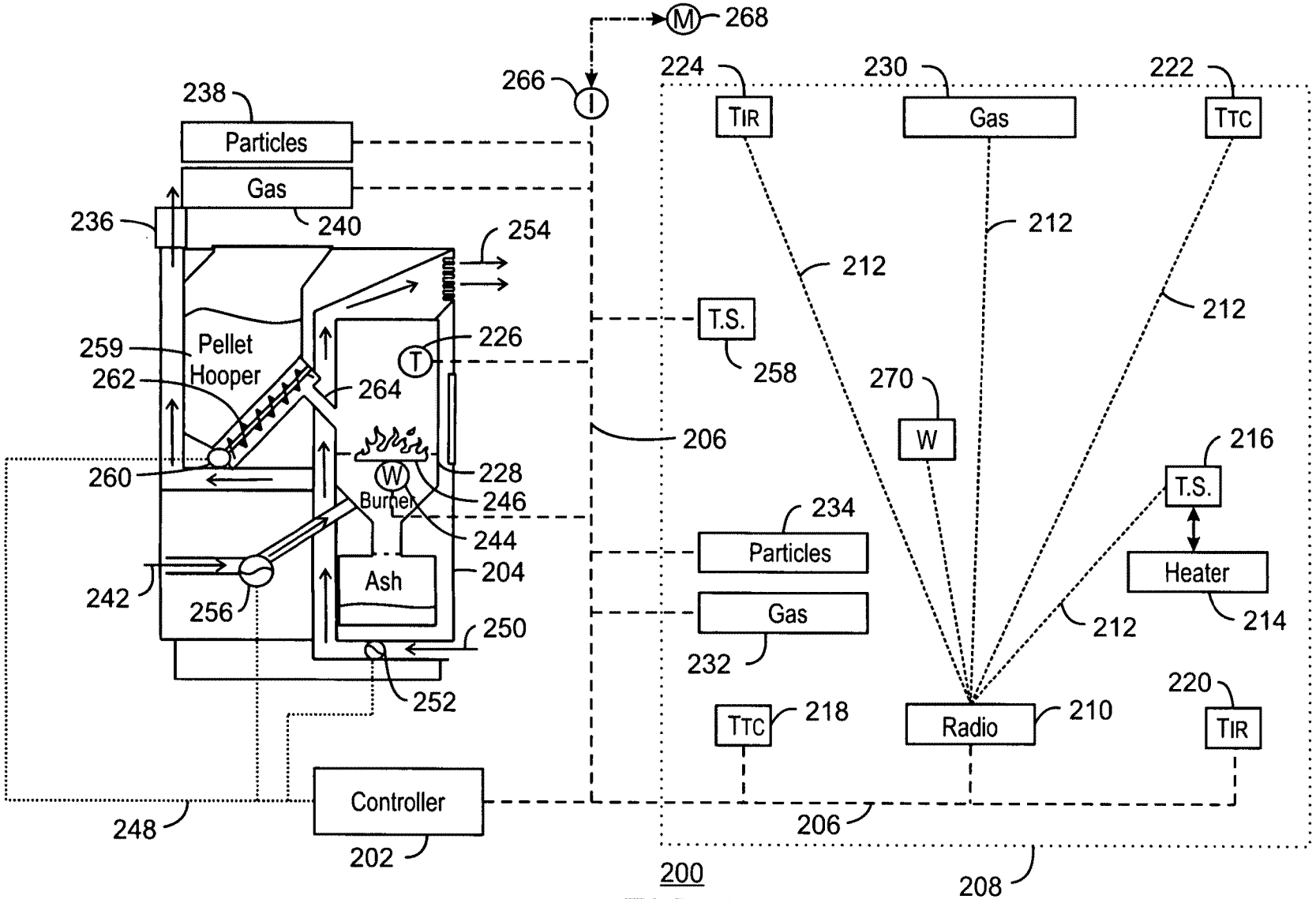
FIG. 2 is a process flow diagram of a combustion heating system that has a controller.

FIG. 2 is a process flow diagram of a combustion heating system 200 that has a controller 202. In this example, the combustion heating system 200 includes a wood pellet furnace 204. The controller 202 may be linked to a communications network 206 that couples the controller 202 to sensors distributed throughout the heated zone 208. The communications network 206 may also link the controller to a number of sensors integrated into the wood pellet furnace 204. The communications network 206 may be used to couple to a wireless access point (WAP) 210, for example, providing a Wi-Fi network. The WAP 210 may be used to provide a wireless network 212 to any number of other devices, inside or outside of the heated zone 208. The controller 202 may work cooperatively with other devices, such as a secondary heating system 214, by connecting to gateway devices, such as a wireless thermostat 216 on the secondary heating system 214. This may be useful for activating the secondary heating system 214 if the fuel runs out, among other issues.

Temperature sensors, including, for example, a wired thermocouple sensor 218, a wired infrared sensor 220, a wireless thermocouple sensor 222, or a wireless infrared sensor 224, among others, may be distributed throughout the heated zone 208. The temperature sensors may be placed at known distances from the combustion heating system 200 to provide the measurements that may be used by a mathematical model in the controller 202 to adjust the combustion heating system 200. Similarly, temperature sensors may be placed in the wood pellet furnace 204, such as a temperature sensor 226 in the firebox 228. Gas composition sensors may be used in the heated zone 208 to monitor for any combustion byproducts that may have entered the heated zone 208. The gas composition sensors may include, for example, a wireless gas composition detector 230 to monitor the air for CO, a wired gas composition detector 232 to monitor the air for CO, and a wired particulate detector 234 to monitor for smoke, soot, and other particulate byproducts of combustion. This information may be used to alert occupants of the heated zone 208 to hazardous conditions.

Gas composition sensors may also be used in the wood pellet furnace 204, for example, on the flue 236. The gas composition sensors may include a particle sensor 238 to determine the amount of soot and other fine particles generated in the combustion process. A gas composition detector 240 may monitor the flue gas for CO, $O_2$, $CO_2$ and other relevant gases. Information obtained from these sensors 238 and 240 may be used to adjust the operating parameters of the combustion heater, for example, leading to increases or reductions in the flow of combustion air 106, among others.

A weight sensor 244 may be used on the fuel grate 246 to measure the amount of fuel already in the furnace. This may be used to estimate the required fuel load to reach a particular temperature.

The wood pellet furnace 204 may include any number of other units, for example, with control points coupled to the controller 202 by a control network 248. The control network 248 may include a wireless or wired network coupling the controller 202 to smart devices. In some embodiments, the control network 248 is simply a set of individual control lines leading from relays or motor drive controllers to the individual units in the wood pellet furnace 204.

Room air 250 may be brought in from the heated zone 208, and passed through a room air blower 252 to be circulated around the firebox 228, and returned to the heated zone 208 as heated air 254. The room air blower 252 may be variable speed with the speed adjusted by the controller 202. In some embodiments, the room air blower 252 may be on/off with the controller 202 turning on the room air blower 252 when the temperature sensor 226 in the firebox 228 reaches a preselected level, e.g., 150° C. or higher.

A combustion air blower 256 may bring in combustion air 242 from the outside, and blow it into the firebox 228. The speed of the combustion air blower 256 may be adjusted by the controller 202 based, for example, on the amount of fuel in the firebox 228, the temperature set at a thermostat 258 in the heated zone 208, or other measurements, such as the measurements from the gas composition sensors 238 and 240 on the flue 236.

In the wood pellet furnace 204, the fuel may be held back from the combustion, for example, in a pellet hopper 259, or other fuel bin. The fuel feed rate may be controlled by a screw drive motor 260, that turns a feed screw 262 to move the fuel to a fuel chute 264. The fuel drops through the fuel shoot onto the fuel grate 246. The controller 202 may adjust the fuel feed rate by adjusting the speed of the screw drive motor 260.

The controller 202 may use parametric models to control the speed of the combustion air blower 256, the room air blower 252, fuel feed rate, fuel weight, and the like, based on the set point for the heated zone 208, the measured temperature for the heated zone 208, fuel consumption and the like. Such models may allow the fuel consumption to be minimized while ensuring user thermal comfort levels are maintained. Further, the parametric models may be coupled with machine learning optimization algorithms to improve the operation of the system, and enable the system to adapt to changing conditions.

The performance of the combustion heating system 200 is tracked by the weight sensor 244, the temperature sensors 218-226, the gas composition sensors 230-234, 238, and 240, and the speed settings for the blowers 252 and 256. During operation, the controller 202 of the combustion heating system 200 may minimize user interactions for adjusting the desired temperature, e.g., the set point of the thermostat 258. The system is dynamic, e.g., as the fuel is consumed, and as the outside temperatures rise or fall, the user can be provided with an anticipatory alert informing them that fuel needs to be added by a certain time so that the room temperature can be maintained, for example, two hours before the system runs low on fuel, one hour before the system runs low on fuel, thirty minutes before the system runs low on fuel, and the like. The period of time may be calculated based on the specific heat, c, of the fuel, as discussed with respect to the equations below, and compared to a preset limit, e.g., an amount of time before the low fuel point is reached, as desired by the user. The user can then use the anticipatory alert to add fuel to the system to increase the reserve heat.

The combustion heating system 200 of FIG. 2 is merely an example, and is not to imply that every unit will be present in every embodiment. For example, fewer temperature sensors 218-226 may be used in the heated zone 208. Further, the blowers may not be variable speed, or may be replaced with controllable dampers. Although a wood pellet furnace 204 is used in this illustration, and number of other combustion heaters may be used instead, such as a fireplace, a wood stove, or a peat stove, among others. In some embodiments, the radio 210 may be integrated into the controller 202.

Other systems may be used in the combustion heating system 200. In one embodiment, the communications network 206 may be linked to an Internet connection 266. This can allow the controller 202 to send alerts, such as anticipatory alerts and gas composition alerts, to a mobile device 268. The messages may be sent as text messages using the short message service (SMS). In some embodiments, an app may be used to receive the messages and alert a user. The App may also allow remote control or shut-down of the combustion heating system 200. The sending of alerts to a mobile device 268 may be useful for alerting a person outside of the premises, for example, when a gas concentration alert has sounded.

A wearable device 270 may be linked to the radio 210, for example, through a Bluetooth or Low Energy Bluetooth connection, as described herein. The wearable device 270 may be clipped to clothing or set on a surface near a user to provide the user with anticipatory alerts or gas composition alerts. For gas composition alerts, the wearable device 270 may be configured to emit loud tones to wake a user. The wearable device 270 may be useful if a heated zone 208 covers multiple rooms, so that an alerting device can be kept with a user.

Figure 3:
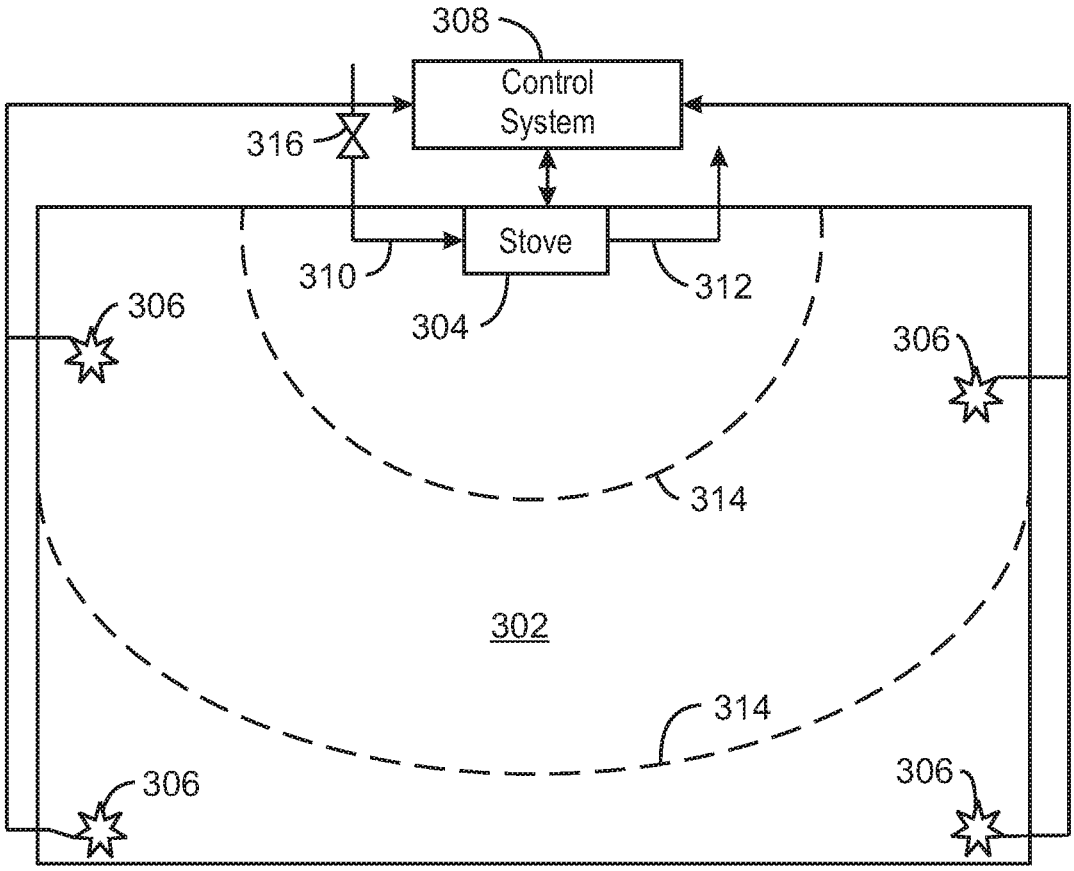
FIG. 3 is a schematic diagram of controlling the temperature of a room with a combustion heating system, e.g., a stove, and multiple temperature sensors.

FIG. 3 is a schematic diagram of controlling the temperature of a room 302 with a combustion heating system, e.g., a stove 304, and multiple temperature sensors 306. A combustion heater control system 308 may monitor the temperature sensors 306 and control the stove 304. As described with respect to FIG. 2, weight sensors in the combustion heater feed into the control system. For example, a model correlating of weight and fuel type to desired temperature may be used to inform a user if sufficient fuel to meet the desired temperature is present, and for how long that temperature can be maintained. The area of the room 302 to be heated and the historical temperature readings from each temperature sensor 306 help provide a more accurate estimate for this calculation by allowing the derivation of models for the rate of temperature change in the environment for a given configuration of the combustion heater.

The techniques enable the flow of combustion air 310 to be regulated so that a comfortable room temperature in maintained, while maximizing the combustion time of the fuel. Further, the flow of combustion air 310 may be maintained to ensure that the combustion rate is sufficient to avoid the production of harmful combustion gases, e.g., carbon monoxide, in the 312. The main energy waste in using combustion heaters, such as the stove 304, is an oversupply of heat 314 making the room 302 too warm. Further waste occurs when too much fuel is used in the fire, for example, leaving the fire burning long after the occupants have left the room 302.

Generally, the system is dynamic, e.g., as the fuel is consumed, and outside temperatures rise or fall, a user can be warned how much longer the room temperature can be maintained. Accordingly, more fuel may be added if desired.

The combustion heater control system 308 may be driven by a control signal the magnitude of which can be directly related the amount of change required. For example, the control signal can be used to actuate an air inlet control valve 316. The discrete time magnitude of the stove air intake control signal, y may be calculated as shown in equation 1.

$$y[n]=\Sigma_{k=0}^{m}h[k]x[n-k] \quad \text{(Eqn. 1)}$$

In equation 1, y[n] is the present value of the stove air intake control signal, h[k] is the $k^{th}$ coefficient of the $M^{th}$ order causal finite impulse response (FIR) filter. The term x denotes the discrete time required heat energy samples, which may be calculated as shown in equation 2.

$$x[n]=q=mc\Delta T \quad \text{(Eqn. 2)}$$

In equation 2, q is the heat energy, m is the mass of the remaining fuel, c is the specific heat of the fuel, and ΔT is the required change in temperature.

The required change in temperature, ΔT, may be calculated as shown in Eqn. 3.

$$\Delta T=T_{desired}-T_{current} \quad \text{(Eqn. 3)}$$

In equation 3, $T_{desired}$ and $T_{current}$ are the desired temperature and current temperature in degrees Celsius, respectively. $T_{current}$ can be either a single temperature spot measurement or an average temperature calculation based on averaged observations from N temperature measurements obtained via the wireless network, which may be calculated as shown in equation 4.

$$T_{current}=\frac{1}{N}\sum_{k=0}^{N}x_t[k] \quad \text{(Eqn. 4)}$$

In equation 4, N is the number of temperature sensors 306, and $x_t[k]$ is a temperature sensor observation for the $k^{th}$ sensor.

The use of the modeling equations may reduce the main energy wastes associated with combustion heaters, e.g., the over-supply of heat and an over-supply of fuel. Further, they may make the operation of the combustion heater safer and augment it with output data which could feed into a larger environmental monitoring system. The model described with respect to FIG. 3 is not limited to the terms shown. Any number of other equations may be added, including, for example, machine learning algorithms to adjust the weighting of the terms, among others.

The modeling equations may be used to provide a predictive alert to a user. For example, the equations may be used to predict when the heat output from the fuel may drop below levels used to maintain a temperature in the environment, e.g., a maintenance level. An alert may then be provided to the user at a predetermined time before the heat output drops below the maintenance level. The alert may be presented at the control panel, for example, as a background color change, a tone, a light, or any combinations thereof. In addition, alerts may be sounded at a remote device, such as the wearable device or mobile communications device described herein.

Figure 4:
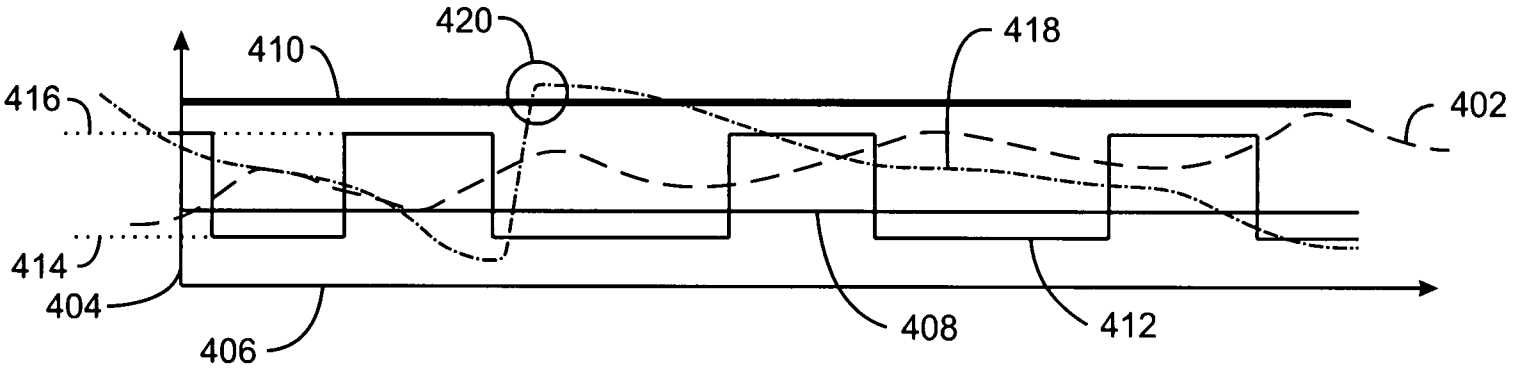
FIG. 4 is a plot of temperature versus time as the temperature is controlled using fuel and air flow to a combustion heater.

FIG. 4 is a plot 400 of temperature 402, on axis 404, versus time 406 as the temperature is controlled using fuel and air flow to a combustion heater. The temperature set points are used to define a user preferred temperature range, e.g., with a lower limit 408 and an upper limit 410. The operation status of the combustion air blower is indicated as plot 412. In this case, the blower is not variable speed, but merely on/off, wherein the off state is at line 414 and the on state is at line 416.

The energy 418 stored in the remaining fuel in the combustion heater is also plotted against axis 404. FIG. 4 provides an example of how the temperature 402, for example, at an environmental temperature sensor or as an average of sensors, and energy 418 remaining in the available fuel is impacted by the changing state of the combustion heater. There may be a significant lag between the control actuations of the combustion heater and a corresponding change of temperature 402 in the environment. By using temperature sensors throughout the heated environment, it is possible to empirically derive models for the temperature response of the environment to different combustion heater types and control configurations. In various embodiments, these include the type of combustion heater, such as a wood stove, a peat stove, a wood pellet furnace, and the like. Further, the plot of the energy 418 remaining in the fuel may be used to indicate a low fuel condition, e.g., a point at which the remaining fuel is insufficient to maintain the temperature. A user may select an interval, or preselected time, before this event for an anticipatory alert.

The control configurations may include combustion air open/closed, blower turned on/off, blower speed, time since new fuel addition or fuel addition rate, and any stimuli which affect the rate of fuel consumption and heat output. With such a model it is possible to utilize machine learning optimization to plan the times at which the combustion heater's controls should be actuated and when fuel should be inserted to optimally maintain the desired temperature bounds within the room while minimizing fuel consumption.

Where a remotely controllable combustion air vent or blower exists it may be controlled by the system. For example, the blower may be activated at regular points, or when the temperature 402 drops below a set point, among others. In some embodiments, the blower may be manually actuated by the user. If so, this may be sensed and incorporated this information into the algorithms. If automatic fuel feed exists, the minimum heat requirements for the self-sustained combustion of new fuel material may be predicted allowing an automatic or manual feed of new fuel in a just-in-time approach. If no automatic feed is available we can notify the user in advance of the time to add new fuel. Internet-of-things (IoT) sensors and systems in the home, like smart appliances, motion sensors, power sensors, TV state indicators, and the like, may be used to notify a user to add fuel at times which are estimated to minimize interruptions.

Further, a hysteretic control may be used to maintain the sensed environmental temperature. However, the lag evident in FIG. 4 illustrates that the temperature in the room continues to change significantly after a change in the combustion heater settings. Accordingly, such an approach may be less than optimal, but may be improved upon by a machine learning optimization approach to heating control.

The placement of temperature sensors at known distances as shown in FIGS. 2 and 3 may be implemented to provide an approximate area, or volume of air to be heated by the combustion heater. This could be implemented during installation. A controller for a combustion heater may support multiple sensor inputs, and an installer may configure the system as the sensors are installed, e.g., entering their distances from the combustion heater as part of the initial setup.

Figure 5:
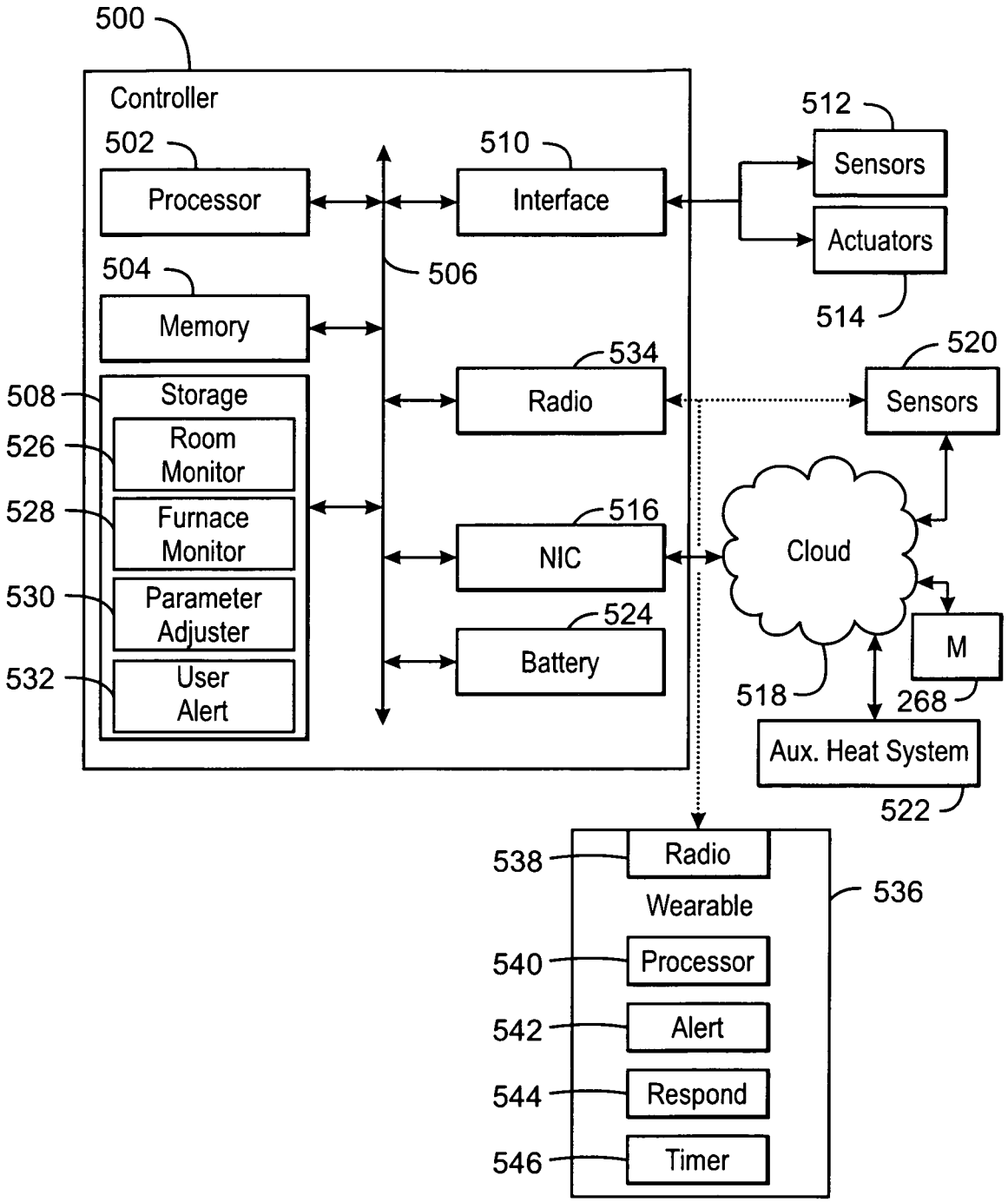
FIG. 5 is a block diagram of components that may be present in a controller used for controlling a combustion device.

FIG. 5 is a block diagram of components that may be present in a controller 500 used for controlling a combustion device. Like numbered items are as discussed with respect to FIG. 2. The controller 500 may include any combinations of the components. The components may be implemented as ICs, portions thereof, discrete electronic devices, or other modules, logic, hardware, software, firmware, or a combination thereof adapted in the controller 500, or as components otherwise incorporated within a chassis of a larger system. The block diagram of FIG. 5 is intended to show a high level view of components of the controller 500. However, some of the components shown may be omitted, additional components may be present, and different arrangement of the components shown may occur in other implementations. The controller 500 may be used to control any number of different types of combustion heaters, for example, as described with respect to FIGS. 1-3.

As seen in FIG. 5, the controller 500 may include a processor 502, which may be a microprocessor, a multi-core processor, a multithreaded processor, an ultra-low voltage processor, an embedded processor, or other known processing element. The processor 502 may be a part of a system on a chip (SoC) in which the processor 502 and other components are formed into a single integrated circuit, or a single package. As an example, the processor 502 may include an Intel® Architecture Core™ based processor, such as a Quark™, an Atom™, an i3, an i5, an i7, or MCU-class processors, or another such processor available from Intel® Corporation, Santa Clara, Calif. However, other low power processors may be used, such as available from Advanced Micro Devices, Inc. (AMD) of Sunnyvale, Calif., a MIPS-based design from MIPS Technologies, Inc. of Sunnyvale, Calif., an ARM-based design licensed from ARM Holdings, Ltd. or customer thereof, or their licensees or adopters. These processors may include units such as an A5/A6 processor from Apple® Inc., a Snapdragon™ processor from Qualcomm® Technologies, Inc., or an OMAP™ processor from Texas Instruments, Inc.

The processor 502 may communicate with a system memory 504 over a bus 506. Any number of memory devices may be used to provide for a given amount of system memory. As examples, the memory can be random access memory (RAM) in accordance with a Joint Electron Devices Engineering Council (JEDEC) low power double data rate (LPDDR)-based design such as the current LPDDR2 standard according to JEDEC JESD 209-2E (published April 2009), or a next generation LPDDR standard to be referred to as LPDDR3 or LPDDR4 that will offer extensions to LPDDR2 to increase bandwidth. In various implementations the individual memory devices may be of any number of different package types such as single die package (SDP), dual die package (DDP) or quad die package (Q17P). These devices, in some embodiments, may be directly soldered onto a motherboard to provide a lower profile solution, while in other embodiments the devices are configured as one or more memory modules that in turn couple to the motherboard by a given connector. Any number of other memory implementations may be used, such as other types of memory modules, e.g., dual inline memory modules (DIMMs) of different varieties including but not limited to microDIMMs or MiniDIMMs. For example, a memory may be sized between 2 GB and 16 GB, and may be configured as a DDR3LM package or an LPDDR2 or LPDDR3 memory, which is soldered onto a motherboard via a ball grid array (BGA).

The components may communicate over a bus 506. The bus 506 may include any number of technologies, including industry standard architecture (ISA), extended ISA (EISA), peripheral component interconnect (PCI), peripheral component interconnect extended (PCIx), PCI express (PCIe), or any number of other technologies. The bus 506 may be a proprietary bus, for example, used in a SoC based system. Other bus systems may be used, such as the $I^2C$ interface, the SPI interfaces, and point to point interfaces, among others.

To provide for persistent storage of information such as data, applications, one or more operating systems and so forth, a mass storage 508 may also couple to the processor 502. To enable a thinner and lighter system design the mass storage may be implemented via a solid state disk drive (SSDD). However, the mass storage may be implemented using a micro hard disk drive (HDD) in some controllers 500. Further, any number of new technologies may be used for the mass storage 508 in addition to, or instead of, the technologies described, such resistance change memories, phase change memories, holographic memories, or chemical memories, among others. For example, the controller 500 may incorporate the 3D XPOINT memories from Intel® and Micron®.

The bus 506 may couple the processor 502 to an interface 510 that is used to connect external devices. The external devices may include sensors 512, such as fuel weight sensors, temperature sensors, gas sensors, particulate sensors, and the like, as described herein. The interface 510 may be used to connect the controller 500 to actuators 514, such as blower motors, dampers, audible sound generators, visual warning devices, and the like.

While not shown, various input/output (I/O) devices may be present within, or connected to, the controller 500. For example, a display may be included to show information, such as temperature set points, sensor readings, or actuator position. An input device, such as a touch screen or keypad may be included to accept input.

The controller 500 can include a network interface controller 516 to communicate with a computing network 518 through an Ethernet interface. The controller may communicate with the computing network 518 wirelessly, for example, as described with respect to FIG. 2. The controller 500 may utilize an external radio used to implement Wi-Fi™ communications in accordance with the Institute of Electrical and Electronics Engineers (IEEE) 802.11 standard such as shown in FIG. 2.

The controller 500 may be part of an ad-hoc or mesh network in which a number of devices pass communications directly between each other, for example, following the optimized link state routing (OLSR) Protocol, or the better approach to mobile ad-hoc networking (B.A.T.M.A.N.), among others. The computing network 518 may be used to communicate with sensors 520 or an auxiliary heating system 522, for example, as described with respect to FIG. 2. The controller 500 may have a local power source, such as a battery 524, for backup in case of main power loss. The power from the battery 524 may be used to provide power to sensors 512 and actuators 514 in addition to the controller 500 to maintain control of the combustion heater during a power loss.

The mass storage 508 may include a number of modules to implement the self-monitoring functions described herein. These modules may include a room monitor 526 that tracks the temperature from one or more sensors in a room or heated zone, as well as monitoring gas sensors and particulate sensors in the room. A furnace monitor 528 may track temperature and other sensor reading from the combustion heater, such as the weight of the remaining fuel, and gas composition and particulate sensors on the flue.

A parameter adjuster 530 may use the sensor readings from the room monitor 526 and the furnace monitor 528 in a model to calculate parameter adjustments for the combustion heater. These parameters may include, for example, a combustion air flow damper, a combustion air flow blower, a room air blower, a fuel feed rate, and the like.

A user alert module 532 may inform a user of conditions that need attention. This may be the activation of a message on a control panel, an SMS message to a cell phone, an alert on a wearable device, or a single tone at a panel, for example, informing the user that more fuel will need to be added at a certain point in time to maintain temperature, e.g., an anticipatory alert. For other conditions, such as CO detection in the heated zone or room, the user alert module 532 may activate a stronger alert, such as a flashing light or a siren.

A radio module 534 may be included in the controller 500 to access a portion of the sensors 520, wearable device 536, or both. As discussed with respect to FIG. 2, the wearable device 536 may be used to alert a user, for example, when they are in a different room than the controller.

The radio module 534 may include a wireless local area network (WLAN) transceiver used to implement Wi-Fi™ communications in accordance with the Institute of Electrical and Electronics Engineers (IEEE) 802.11 standard, among others. In addition, the radio module 534 can include a wireless wide area communication system, e.g., according to a cellular or other wireless wide area protocol, such as CDMA, LTE, GSM, and the like. Further, the radio module 534 can include a transceiver compatible with the Bluetooth® or Bluetooth® Low Energy (BLE) standards as defined by the Bluetooth® special interest group. The Radio module 534 may communicate over a wireless personal area network (WPAN) according to the IEEE 802.15.4 standard, among others.

The radio module 534 may communicate with the wearable device 536 through a radio 538 in the wearable device 536, for example, using the BLE standard. The wearable device 536 may include a processor 540 to execute code modules. The modules may include an alert module 542 that activates a tone generator, flashing light, display, or any combinations to provide an anticipatory alert or a gas composition alert. The wearable device 536 may include a respond module 544 that allows the wearable device 536 to confirm that a user has received the alert. In the case of a high priority alert, such as a gas composition alert, a timer module 546 may activate a more forceful alert, such as a flashing light or tone from the wearable if the user has not responded in a particular period, such as one minute, five minutes, and the like. If the user does not respond to the more forceful alert within a period of time, such as two minutes, five minutes, or ten minutes, the wearable may activate a siren, house alert, or a remote alert.

Figure 6:
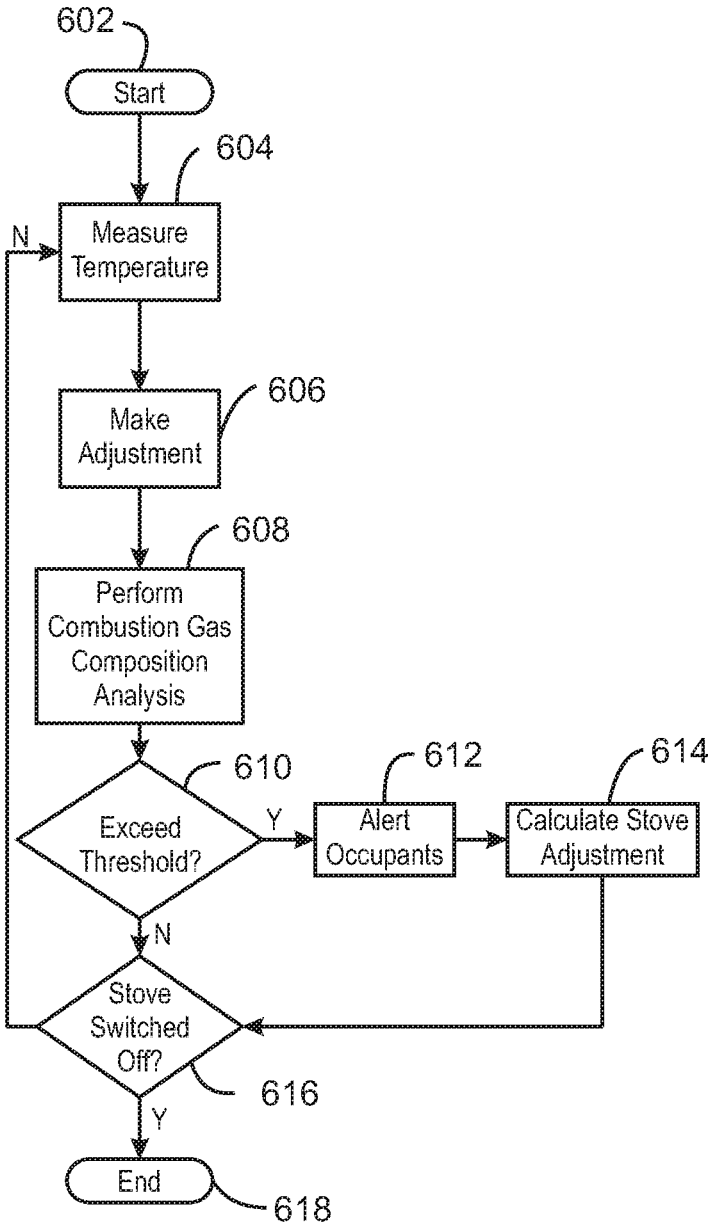
FIG. 6 is a process flow diagram of a method for controlling a temperature of a combustion heater.

FIG. 6 is a process flow diagram of a method 600 for controlling a temperature of a combustion heater. The method 600 may start at block 602 with either a manual activation of the system or by the system detecting an elevated temperature in the combustion heater. At block 604, temperature sensors may be used to measure the room temperature and combustion heater temperature. Additionally, the fuel weight may be measured.

At block 606, any adjustment that may be needed is performed. The adjustments may be computed using a model, as described above. The weight sensors, and the fuel type loaded, which could be manually specified by the user or detected automatically, are used in combination with the desired temperature, previous performance of the combustion heater, the current room temperature and, optionally, the volume of area in the room to estimate how long that temperature can be maintained. During operation, the fuel consumption is tracked by the combustion heater weight sensors. As each room and combustion heater may be different, machine learning algorithms may be used to build training set to support this feature. Any number of algorithms may be used, including regression and optimization, neural networks, Bayesian statistical approaches, fuzzy networks, and the like. Effectively, the combustion heater can make static calculations, or it can learn over time to make more accurate predictions, for example, learning the heat capacity, c, of the fuel. If an adjustment is required, the incoming air valve is actuated to increase or decrease the rate at which the fuel is consumed and hence the energy output of the combustion heater. If more fuel is required, the user is alerted. Further, an anticipatory alert may be provided to a user, for example, when a preset period of time before a low fuel condition is reached. The anticipatory alert may be provided through a control panel, thermostat, wearable device, or a portable device, among others.

At block 608, the gas and particulate exhaust is monitored to ensure it is within safety thresholds. If not, process flow proceeds to block 610, to take a number of actions. The actions may include alerting the occupants at block 612 and calculating a stove adjustment to decrease emissions at block 614. Examples of adjustments include shutting off the air inlet or switching the combustion heater off, among others. The occupants may be alerted through the control panel, wearable devices, mobile devices, and the like. For example, a text, or SMS message, may be sent to a cellular telephone or other mobile device to alert a user. This may be a useful to alert persons outside of the heated zone to check on persons within the heated zone.

If no safety thresholds are exceeded at block 610, at block 616 the control system checks if the combustion heater is still in operation, if so, process flow returns to block 604. If note, or if the fuel is exhausted, the method 600 may end at block 618.

Prior systems may monitor a temperature inside the combustion heater that is in the hundreds of degrees. This temperature is decoupled from the temperature which a user actually experiences in the environment. In these systems, the temperature internal to the combustion heater may maintained in a manually defined range by the use of a hysteretic controller.

In contrast, the present techniques may allow the utilization of simulations which describe the lagged deterministic variation of temperatures which the user actually experiences in the environment. By using such model simulations and appropriate optimization objectives, this approach may increase the comfort of the user and decrease fuel consumption.

Figure 7:
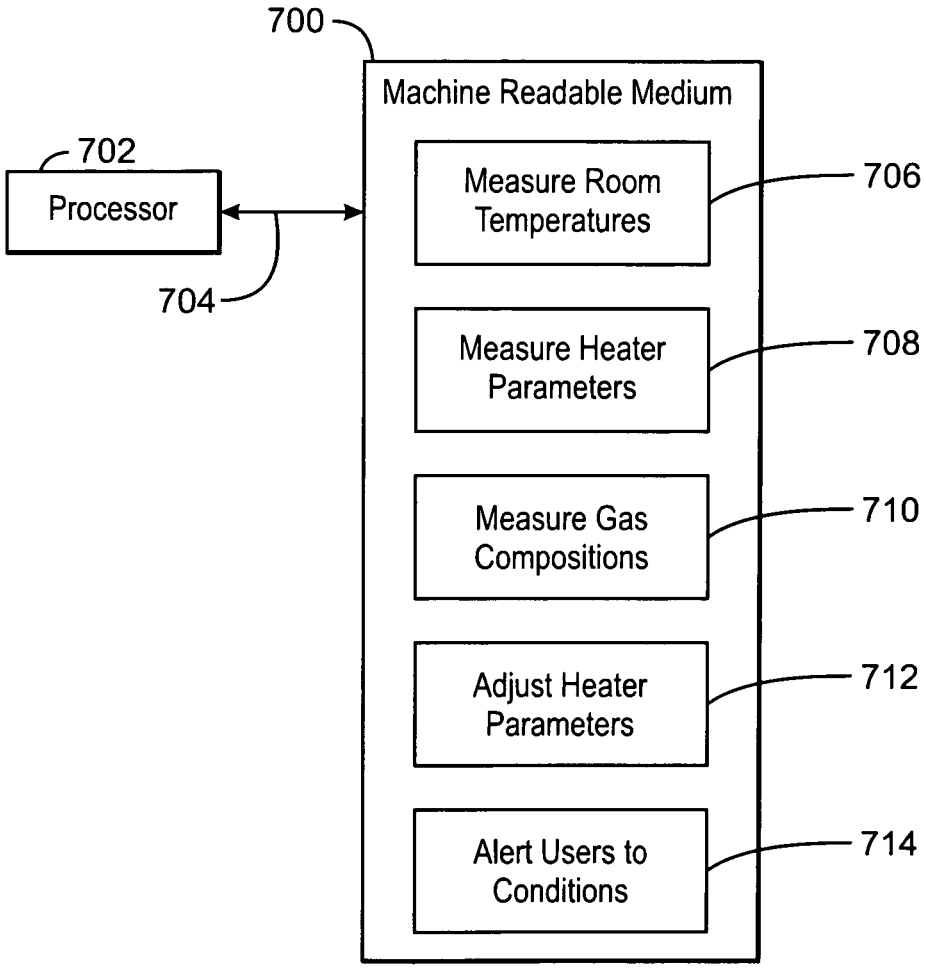
FIG. 7 is a block diagram of a non-transitory, machine readable medium including code to direct a processor to control a combustion heater.

FIG. 7 is a block diagram of a non-transitory, machine readable medium 700 including code to direct a processor 702 to control a combustion heater. The non-transitory, machine readable medium 700 may be accessible over a bus 704, or other link, as described herein. Code 706 may be included to direct the processor 702 to measure room temperature at one or more sensors. Code 708 may be included to direct the processor 702 to measure heater parameters, such as firebox temperature, fuel weight, fuel flow, and the like. Code 710 may be included to direct the processor 702 to measure gas compositions, e.g., gas levels in the room or flue, and particulate levels in the room or flue, depending on what sensors are present Code 712 may be included to adjust the parameters for the combustion heater, for example, by running a model to determine the adjustments needed, and then making adjustments, such as turning blowers on or off, opening dampers, and the like. Code 714 may be included to alert users to conditions, for example, alerting a user when fuel needs to be added, or sounding a horn when gas compositions exceed limits, among others.

EXAMPLES

Example 1 is an apparatus for controlling a combustion heater. The apparatus includes a sensor system that includes a zone temperature sensor in a heated zone and a heater temperature sensor in the combustion heater. The apparatus also includes a combustion air flow control. A control system includes a processor and a storage system. The storage system includes code to direct the processor to monitor the temperature in the heated zone, to monitor the temperature in the combustion heater, to calculate adjustments needed to reach a target temperature in the heated zone, and to adjust the controller to reach the target temperature. Code also is included to direct the processor to provide an alert to a user at a preselected time before the combustion heater reaches a low fuel condition.

Example 2 includes the apparatus of example 1. In this example, the apparatus includes a room air flow controller.

Example 3 includes the apparatus of any one of examples 1 to 2, including or excluding optional features. In this example, the zone temperature sensor includes a number of temperature sensors distributed in the heated zone. Optionally, the number of temperature sensors are at known distances from the combustion heater.

Example 4 includes the apparatus of any one of examples 1 to 3, including or excluding optional features. In this example, the sensor system includes a fuel sensor. Optionally, the fuel sensor includes a weight sensor on a fuel bin. Optionally, the fuel sensor includes a feed rate for a solid fuel feed.

Example 5 includes the apparatus of any one of examples 1 to 4, including or excluding optional features. In this example, the apparatus includes a gas sensor configured to measure a concentration of carbon monoxide. Optionally, the gas sensor is located in a flue gas, and the storage system includes code to direct the processor to adjust conditions to lower the concentration of carbon monoxide in the flue gas and activate an alert on a wearable device.

Example 6 includes the apparatus of any one of examples 1 to 5, including or excluding optional features. In this example, the apparatus includes a particulate sensor. Optionally, the particulate sensor is located in a flue gas, and the storage system includes code to direct the processor to adjust conditions to lower particulates in the flue gas.

Example 7 includes the apparatus of any one of examples 1 to 6. In this example, the apparatus includes a gateway interface to communicate with other heating systems.

Example 8 includes the apparatus of any one of examples 1 to 7. In this example, the apparatus includes a wireless base station that receives information from a wireless sensor.

Example 9 includes the apparatus of any one of examples 1 to 8. In this example, the apparatus includes an alert system to activate an alert on a wearable device, a mobile device, or both if a gas concentration in the heated zone passes a pre-determined threshold.

Example 10 is a method for controlling a combustion heater. The method includes measuring a room temperature, measuring a combustion heater temperature, measuring a fuel weight, and computing an adjustment to an operational parameter to adjust the room temperature. An anticipatory alert is provided to inform a user of a predicted time at which the fuel weight will be too low to maintain the room temperature.

Example 11 includes the method of example 10. In this example, the method includes actuating a combustion air intake to change a rate at which a solid fuel is consumed.

Example 12 includes the method of any one of examples 10 to 11. In this example, the anticipatory alert is provided to a mobile device, a wearable device, or both.

Example 13 includes the method of any one of examples 10 to 12. In this example, the method includes adjusting a fuel feed rate.

Example 14 includes the method of any one of examples 10 to 13, including or excluding optional features. In this example, the method includes monitoring the composition of a flue gas. Optionally, the method includes providing a gas composition alert to a wearable device. Optionally, the method includes adjusting the operational parameter to change a composition of the flue gas. Optionally, the method includes adjusting a flow rate of combustion air to the combustion heater. Optionally, the method includes switching off the combustion heater.

Example 15 is a non-transitory machine readable medium. The non-transitory machine readable medium includes instructions that direct the processor to monitor a temperature in a heated zone, to monitor a temperature in a combustion heater, and to adjust an operational parameter for the combustion heater to change the temperature in the heated zone. The non-transitory machine readable medium includes instructions that direct the processor to provide an anticipatory alert to inform a user that a predicted time for a low fuel condition is within a preset time.

Example 16 includes the non-transitory machine readable medium of example 15. In this example, the non-transitory machine readable medium includes code to direct the processor to: monitor a flue gas composition, adjust the operational parameter for the combustion heater to change the flue gas composition, and activate an alert on a wearable device.

Example 17 includes the non-transitory machine readable medium of any one of examples 15 to 16. In this example, the non-transitory machine readable medium includes code to direct the processor to monitor particulates in a flue gas composition, adjust the operational parameter for the combustion heater to change the particulates in the flue gas, and activate an alert on a wearable device.

Example 18 is a control system for controlling a combustion heater. The control system includes a processor, and a storage system. The storage system includes code to direct the processor to monitor a temperature in a heated zone, monitor a temperature in the combustion heater, calculate adjustments needed to reach a target temperature in the heated zone, and adjust the controller to reach the target temperature. Instructions are also included to direct the processor to alert a user at a preselected time before a low fuel condition is reached.

Example 19 includes the control system of example 18. In this example, the system includes an interface to a room air flow blower.

Example 20 includes the control system of any one of examples 18 to 19, including or excluding optional features. In this example, the system includes an interface to a number of temperature sensors distributed in the heated zone. Optionally, the number of temperature sensors are at known distances from the combustion heater.

Example 21 includes the control system of any one of examples 18 to 20, including or excluding optional features. In this example, the system includes an interface to a fuel sensor. Optionally, the fuel sensor includes a weight sensor in a firebox in the combustion heater. Optionally, the fuel sensor includes a feed rate for a solid fuel feed.

Example 22 includes the control system of any one of examples 18 to 21, including or excluding optional features. In this example, the system includes an interface to a gas sensor configured to measure a concentration of carbon monoxide. Optionally, the gas sensor is located in a flue gas, and wherein the storage device includes code to direct the processor to adjust conditions to lower the concentration of carbon monoxide in the flue gas and activate an alert on a wearable device.

Example 23 includes the control system of any one of examples 18 to 22, including or excluding optional features. In this example, the system includes an interface to a particulate sensor. Optionally, the particulate sensor is located in the flue gas, and the storage system includes code to direct the processor to adjust conditions to lower a concentration of carbon monoxide in the flue gas and activate an alert on a wearable device.

Example 24 includes the control system of any one of examples 18 to 23. In this example, the system includes a gateway interface to communicate with other heating systems.

Example 25 includes the control system of any one of examples 18 to 24. In this example, the system includes a wireless base station that receives information from a wireless sensor.

Example 26 includes the control system of any one of examples 18 to 25. In this example, the system includes an alert system to activate an alert on a wearable device if the gas concentrations breach pre-determined thresholds.

Example 27 is a method for controlling a combustion heater. The method includes measuring a room temperature, measuring a combustion heater temperature, measuring a fuel weight, and computing an adjustment to an operational parameter to adjust the room temperature. The method also includes providing an anticipatory alert to inform a user of a predicted time at which the fuel weight will be too low to maintain the room temperature.

Example 28 includes the method of example 27. In this example, the method includes actuating a combustion air intake to change a rate at which a solid fuel is consumed.

Example 29 includes the method of any one of examples 27 to 28. In this example, the method includes providing the anticipatory alert on a wearable device.

Example 30 includes the method of any one of examples 27 to 29. In this example, the method includes adjusting a fuel feed rate.

Example 31 includes the method of any one of examples 27 to 30, including or excluding optional features. In this example, the method includes monitoring the composition of a flue gas. Optionally, the method includes activating an alert in a heated zone. Optionally, the method includes adjusting an operational parameter to change a composition of the flue gas. Optionally, the method includes adjusting a flow rate of combustion air to the combustion heater. Optionally, the method includes switching off the combustion heater.

Example 32 is an apparatus for controlling a combustion heater. The apparatus includes a sensor system that includes a zone temperature sensor in a heated zone, and a heater temperature sensor in the combustion heater. The apparatus includes a combustion air flow control, and a means for adjusting a controller to reach a target temperature. The apparatus also includes means for alerting a user that the fuel will be low at a predicted time.

Example 33 includes the apparatus of example 32. In this example, the apparatus includes means for controlling an air flow to a combustion process.

Example 34 includes the apparatus of any one of examples 32 to 33. In this example, the apparatus includes means for controlling a fuel flow to a combustion process.

Example 35 includes the apparatus of any one of examples 32 to 34. In this example, the apparatus includes means for controlling a flue gas composition from a combustion process.

Example 36 includes the apparatus of any one of examples 32 to 35. In this example, the apparatus includes means for controlling auxiliary heating system.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the techniques. The various appearances of "an embodiment", "one embodiment", or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

The techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the techniques.

What is claimed is:

1. An apparatus for controlling a combustion heater, comprising:

a sensor system, comprising:

a zone temperature sensor in a heated zone; and a heater temperature sensor in the combustion heater;

a combustion air flow control; and a controller, comprising:

a processor; and a storage system, comprising code to direct the processor to:

monitor the temperature in the heated zone;

monitor the temperature in the combustion heater;

calculate parameter adjustments needed to reach a target temperature in the heated zone;

adjust combustion air, blower power, blower speed, new fuel addition, or fuel addition rate, or any combinations thereof to maintain the target temperature;

estimate a remaining fuel load;

calculate a period of time by the end of which fuel needs to be added to maintain room temperature, the period of time to be calculated using at least the estimated remaining fuel load and historical temperature readings from the heated zone; and provide an anticipatory alert to a user comprising the period of time.

2. The apparatus of claim 1, comprising a room air flow blower.

3. The apparatus of claim 1, wherein the zone temperature sensor comprises a plurality of temperature sensors distributed in the heated zone.

4. The apparatus of claim 3, wherein the plurality of temperature sensors are at known distances from the combustion heater.

5. The apparatus of claim 1, wherein the sensor system comprises a fuel sensor.

6. The apparatus of claim 5, wherein the fuel sensor comprises a weight sensor on a fuel bin.

7. The apparatus of claim 5, wherein the fuel sensor comprises a feed rate for a solid fuel feed.

8. The apparatus of claim 1, comprising a gas sensor configured to measure a concentration of carbon monoxide.

9. The apparatus of claim 8, wherein the gas sensor is located in a flue gas, and wherein the storage system comprises code to direct the processor:

to adjust conditions to lower the concentration of carbon monoxide in the flue gas; and activate an alert on a wearable device.

10. The apparatus of claim 1, comprising a particulate sensor.

11. The apparatus of claim 10, wherein the particulate sensor is located in a flue gas, and wherein the storage system comprises code to direct the processor to adjust conditions to lower particulates in the flue gas.

12. The apparatus of claim 1, comprising a gateway interface to communicate with other heating systems.

13. The apparatus of claim 1, comprising a wireless base station that receives information from a wireless sensor.

14. The apparatus of claim 1, comprising an alert system to activate an alert on a wearable device, a mobile device, or both if a gas concentration in the heated zone passes a pre-determined threshold.

15. A method for controlling a combustion heater, comprising:

measuring a room temperature; measuring a combustion heater temperature;

measuring a fuel weight;

computing an adjustment to an operational parameter to adjust the room temperature;

estimating a remaining fuel load;

calculating a period of time by the end of which fuel needs to be added to maintain room temperature, the period of time to be calculated using at least the estimated remaining fuel load and historical temperature readings of the room temperature; and providing an anticipatory alert to inform a user of the calculated period of time.

16. The method of claim 15, comprising actuating a combustion air intake to change a rate at which a solid fuel is consumed.

17. The method of claim 15, wherein the anticipatory alert is provided to a mobile device, a wearable device, or both.

18. The method of claim 15, comprising adjusting a fuel feed rate.

19. The method of claim 15, comprising monitoring a composition of a flue gas.

20. The method of claim 19, comprising providing a gas composition alert to a wearable device.

21. The method of claim 19, comprising adjusting the operational parameter to change a composition of the flue gas.

22. The method of claim 21, comprising adjusting a flow rate of combustion air to the combustion heater.

23. The method of claim 21, comprising switching off the combustion heater.

24. A non-transitory, machine readable medium comprising code to direct a processor to:

monitor a temperature in a heated zone;

monitor a temperature in a combustion heater;

estimate a remaining fuel load;

adjust an operational parameter for the combustion heater to change the temperature in the heated zone; and provide an anticipatory alert to a user within a calculated period of time by the end of which fuel needs to be added to maintain room temperature, the period of time to be calculated using at least the estimated remaining fuel load and historical temperature readings from the heated zone.

25. The non-transitory, machine readable medium of claim 24 comprising code to direct the processor to:

monitor a flue gas composition;

adjust the operational parameter for the combustion heater to change the flue gas composition; and activate an alert on a wearable device.

* * * * *